US005307855A

United States Patent [19]

Martensson, IV

[11] Patent Number: 5,307,855

[45] Date of Patent: May 3, 1994

[54] TAPE DRIVE EXTENDABLE AND RETRACTABLE AWNING ASSEMBLY

[75] Inventor: Olof Martensson, IV, Annapolis, Md.

[73] Assignee: Awnings Unlimited, Inc., Jessup, Md.

[21] Appl. No.: 955,422

[22] Filed: Oct. 2, 1992

[51] Int. Cl.[5] ..... E04F 10/06

[52] U.S. Cl. ..... 160/66; 160/310

[58] Field of Search ..... 160/66, 68, 265, 309, 160/310; 49/199; 74/89.21; 474/205

[56] References Cited

U.S. PATENT DOCUMENTS

| | | | |
|---|---|---|---|
| 2,140,220 | 12/1938 | Colvin, Jr. | 135/5 |
| 2,668,586 | 2/1954 | Luckie | 160/241 |
| 4,414,778 | 11/1983 | Carli | 49/199 |
| 4,424,685 | 1/1984 | Ibrahim | 62/249 |
| 4,520,684 | 6/1985 | Meyer et al. | 74/89.21 |
| 4,606,157 | 8/1986 | Esposito | 52/173 |
| 4,643,701 | 2/1987 | Meyer et al. | 474/153 |
| 4,854,363 | 8/1989 | Fouquet | 160/98 |
| 4,934,437 | 6/1990 | Kraeutler | 160/271 X |
| 5,016,701 | 5/1991 | Vore | 160/310 X |

*Primary Examiner*—Blair M. Johnson

*Attorney, Agent, or Firm*—Brady, O'Boyle & Gates

[57] ABSTRACT

A tape drive extendable and retractable awning assembly wherein a sprocket driven apertured tape is connected to the leading end of an awning adjacent the opposite lateral edges of the awning. The apertured tapes are guided in channel members housed in frames positioned in proximity to the lateral edges of the awning, and each frame is provided with a weather seal to prevent dirt and dust from accumulating in the guide channels and apertured tapes.

13 Claims, 6 Drawing Sheets

TAPE DRIVE EXTENDABLE AND RETRACTABLE AWNING ASSEMBLY

This invention relates to an extendable and retractable awning assembly for covering and shading patios, side walk restaurants, solar greenhouses, and the like from the elements, and to an improved combination of support frame and drive for selectively extending and retracting the awning assembly to provide the desired shading from solar radiation or protection from rain or the like.

BACKGROUND OF THE INVENTION

Various support frame and drive assemblies have been proposed for moving fabric covers or the like as a covering, examples of which are disclosed in U.S. Pat. Nos. 2,140,220 , dated Dec. 13, 1938; 2,668,586, dated Feb. 9, 1954; 4,424,685, dated Jan. 10, 1984; and 4,606,157, dated Aug. 19, 1986.

The support frame and drive assemblies disclosed in the first three mentioned patents for extending and retracting a cover or curtain, utilize endless loop sprocket chains, belts or cables connected to motor drives and to the cover for extending and retracting the covers. The drive systems in these patents are rather bulky, and the parallel flights of the endless drive chains, belts or cables are spaced apart a substantial distance from each other, thus requiring a substantial amount of space with support for the endless loop drive at opposite ends, thus making the arrangement bulky from an aesthetic standpoint for use in framing for an awning system over top of a patio, side walk restaurant, or attached over the top of a greenhouse, or the like. No support is provided for the endless loop drives throughout their lengths, and it is difficult to maintain the endless loops in tension at both sides of the awning member to evenly drive both sides of the awning member simultaneously to prevent cocking and binding of the leading edge of the awning member or covering, and the structures do not allow an awning to go around a curve.

The latter mentioned U.S. Pat. No. 4,606,157 discloses a curtain or shade for drawing across the inside of a greenhouse. In order to overcome the drawbacks of bulky endless loop drive systems, the opposite lateral edges of the shade are guided in track channels, which creates a substantial amount of friction drag. Cables are connected to the opposite front sides of the shade, and are guided in the same track channels as the shade edges, and extend forwardly from the shade and are wound onto respective constant torque spring loaded rollers at the far end of the shade support frame members. However, this system also has drawbacks, since as the shade is rolled from the roller, each lateral edge and forward cable has friction drag on it in the respective guide channels, which drag may be different for opposite edges due to dust, dirt, etc. built-up in the channels, and also the torque of the spring loaded rollers can change with age, thus giving a different pull to opposite front edges of the shade, causing the shade to bind in the guide channels.

While the support frame and drive assemblies shown in the prior art have generally been satisfactory for their intended purpose, for a certain length of time, none have solved the problem of how to provide a compact, strong support frame and compact drive assembly having a commonly driven drive assembly for opposite lateral edges of the awning, which stays in synchronization for constant even extension and retraction of the front edge of the awning, without cocking or binding, and which is substantially resistant to outside weather conditions.

SUMMARY OF THE INVENTION

After considerable research and experimentation, the support frame and tape drive system of the present invention has been devised to overcome the above-noted disadvantages experienced heretofore in prior extendable and retractable awning systems. A loop of flexible plastic tape having two free ends, and having spaced apertures throughout its length, is looped around a toothed or sprocket drive member of the type disclosed in U.S. Pat. Nos. 4,520,684 and 4,643,701 for operating a garage door, so that the teeth on the sprocket drive member engage into the apertures on the tape. A drive sprocket is mounted on each end of a drive shaft connected to a drive motor, and an apertured tape is looped around each of the drive sprockets. The apertured tapes are guided in extended channels provided in support frames positioned adjacent the lateral edges of the awning. The leading edge of the awning is connected to a drawbar having its opposite ends connected to a free end of a respective tape and the trailing edge of the awning is connected to an awning roll on the drive shaft with the two drive sprockets. A seal assembly is provided between the support frames and lateral edges of the awning to prevent dirt, dust and other debris from entering the frame members housing the guide channels.

By this construction and arrangement, an awning extension and retraction assembly is provided which is compact, having a commonly driven drive assembly for opposite lateral edges of the awning, which stays in synchronization for constant, even extension and retraction of the awning, without cocking or binding, and which is substantially resistant to outside weather conditions.

DESCRIPTION OF THE PREFERRED EMBODIMENT

Figure 1:
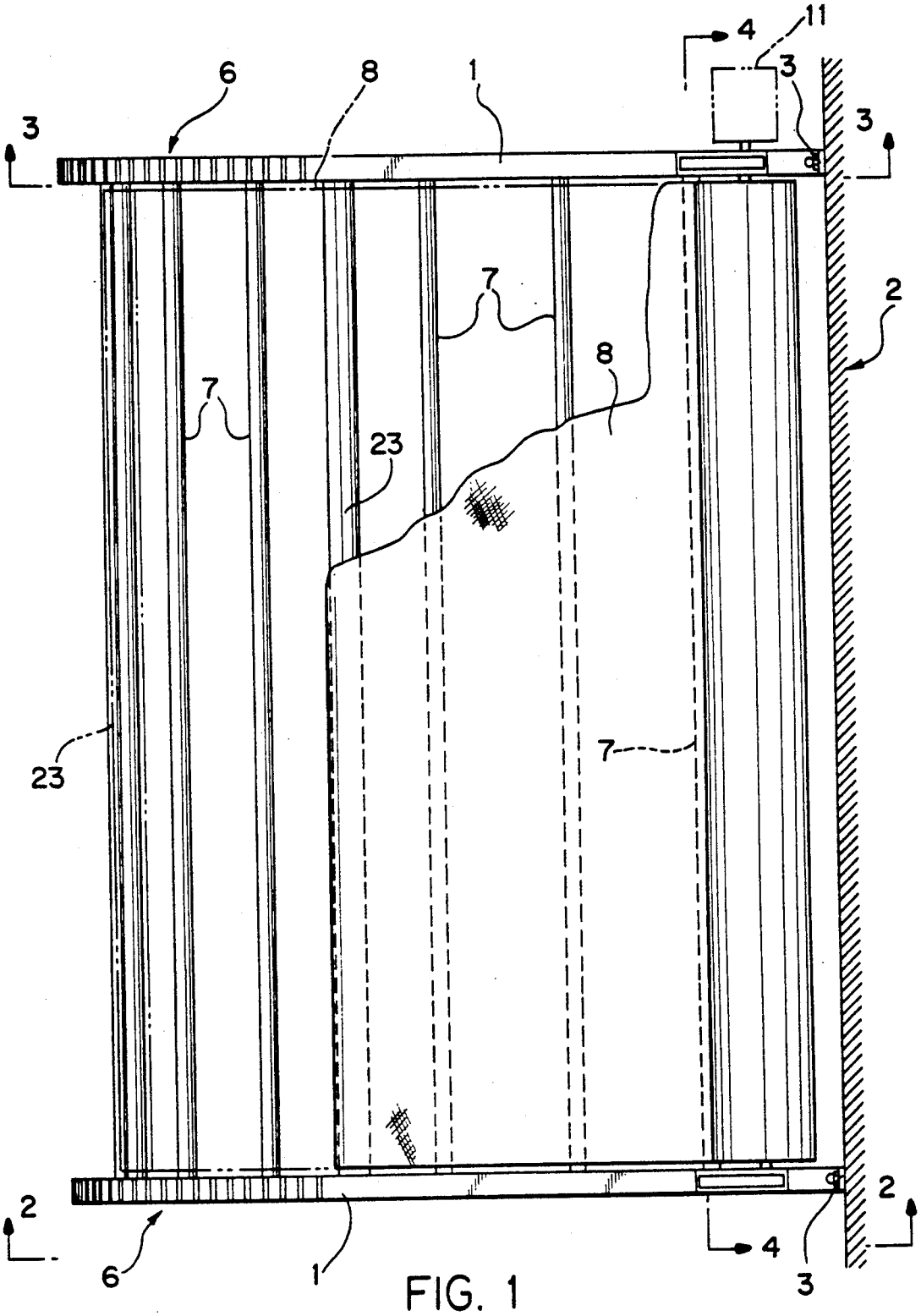
FIG. 1 is a top plan view of the extendable and retractable tape drive awning assembly of the present invention.
Figure 2:
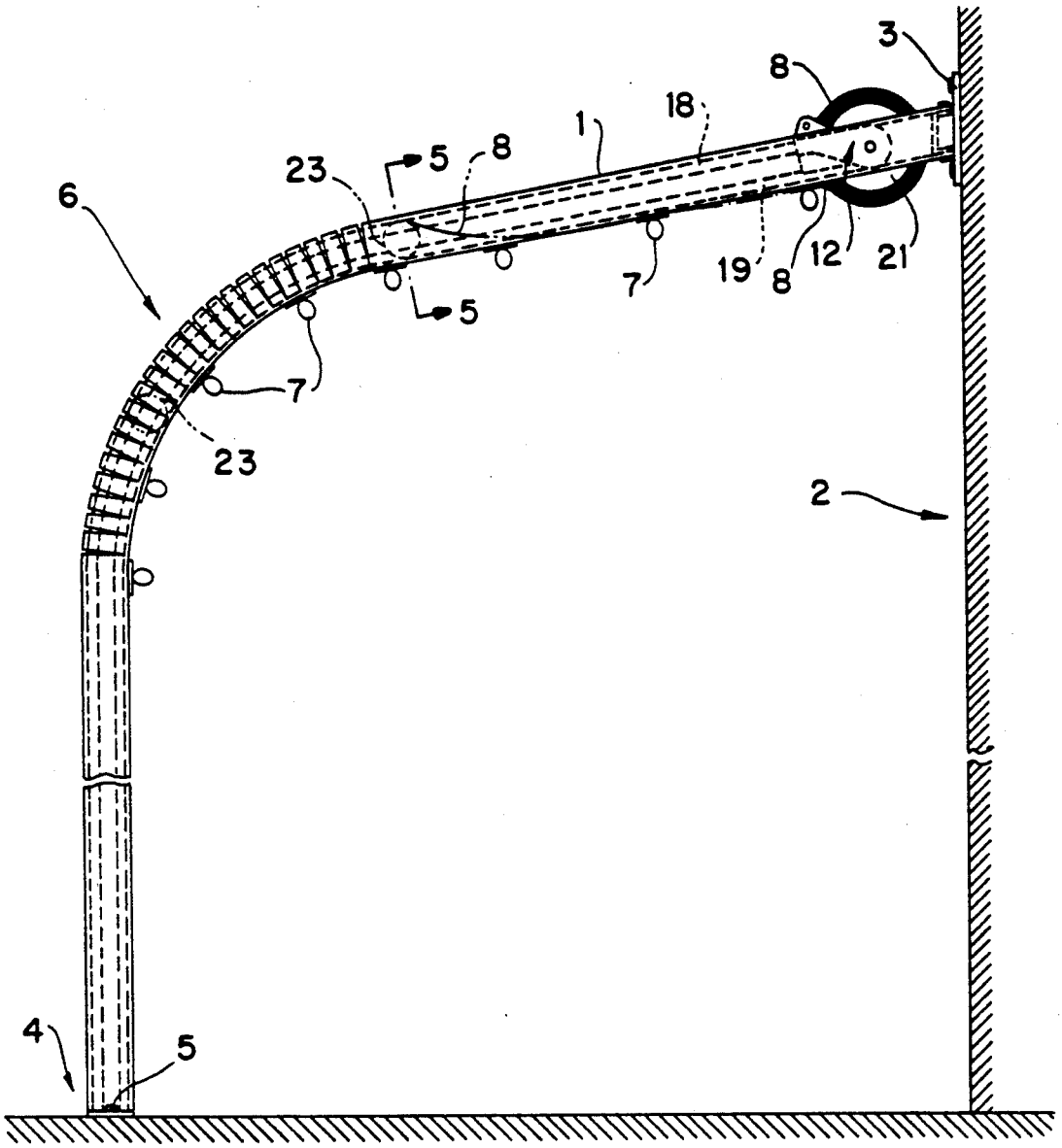
FIG. 2 is a side elevational view of the awning support frame assembly taken substantially along the line 2—2 of FIG. 1.
Figure 3:
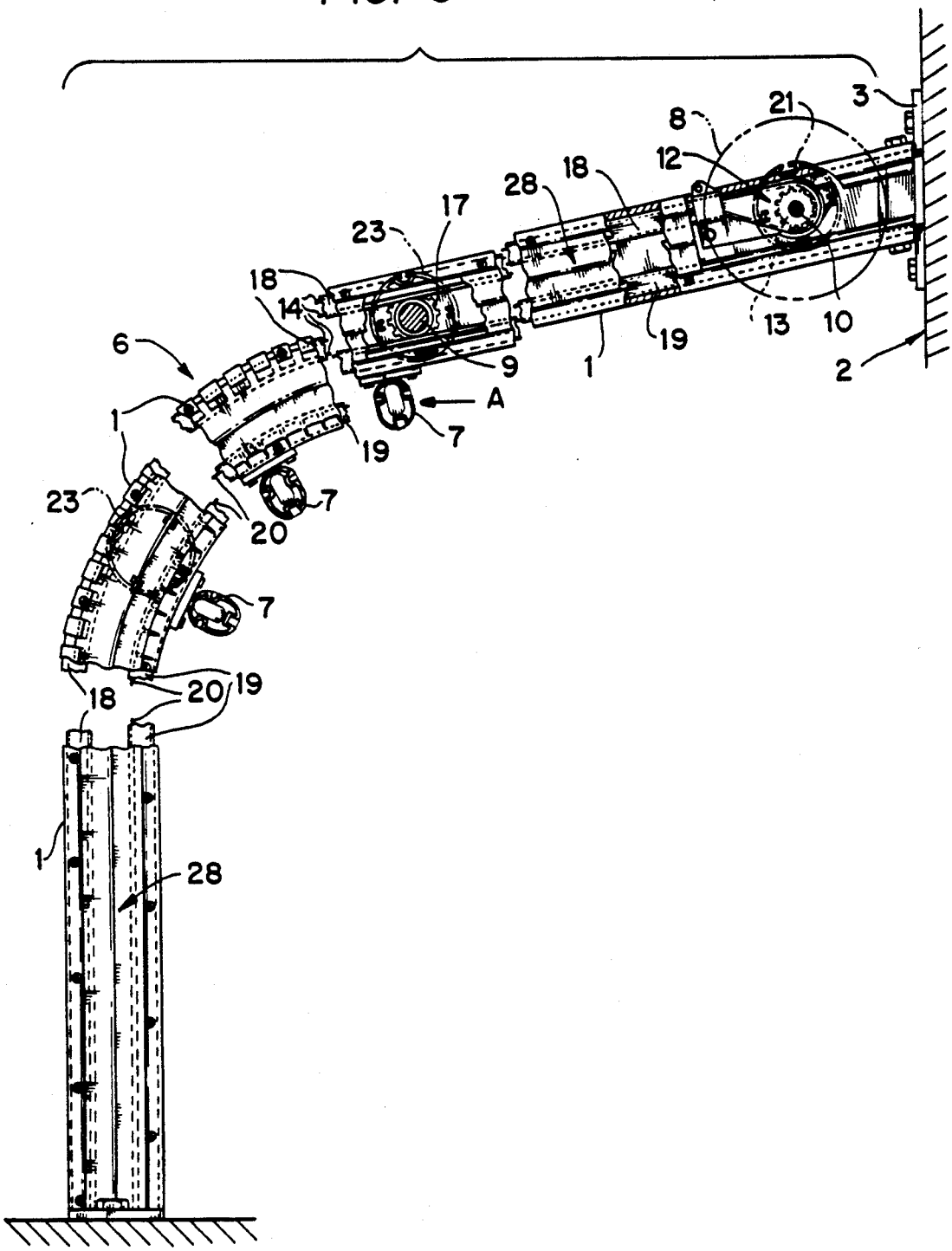
FIG. 3 is a vertical, fragmentary, fore-shortened, cross-sectional view, on an enlarged scale, taken substantially along line 3—3 of FIG. 1 and showing the awning support frame assembly and tape drive mechanism.
Figure 5:
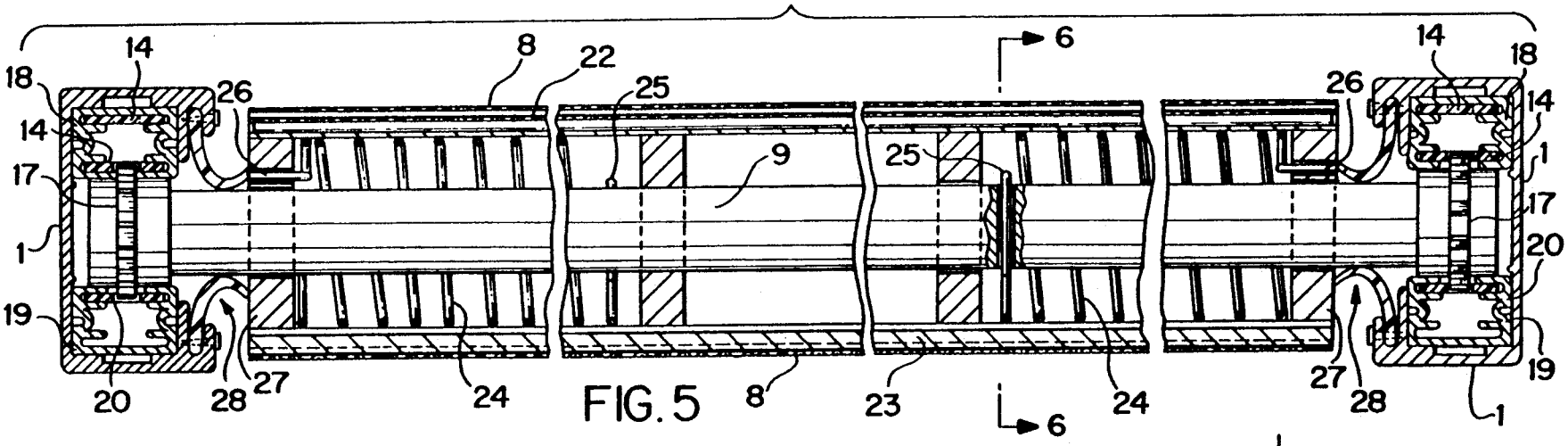
FIG. 5 is an enlarged longitudinal, cross-sectional view taken substantially along line 5—5 of FIG. 2 showing the awning drawbar assembly and its connection to the drive tapes.
Figure 7:
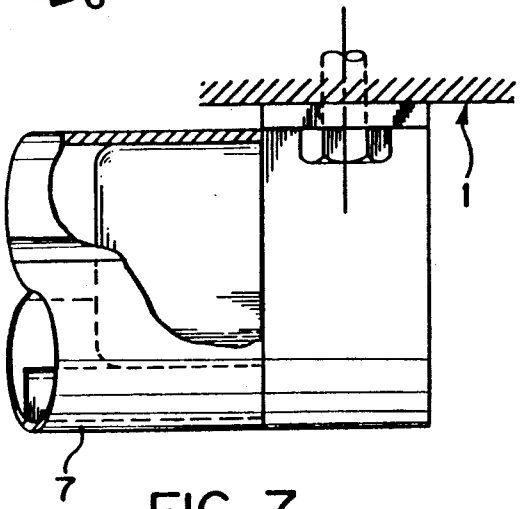
FIG. 7 is an enlarged fragmentary view, partly in longitudinal cross-section, showing the connection of a frame cross member to the end frame member, the view being taken in the direction of arrow A in FIG. 3.

Referring to the drawings and more particularly to FIGS. 1, 2 and 5, the extendable and retractable tape drive awning assembly of the present invention comprises a pair of laterally spaced frame members 1 having their opposite ends secured to a building 2 as at 3, and to the ground 4 as at 5. The medial portion of each frame member 1 is cut so that the frames can be bent to provide a curved section 6, and a plurality of transversely extending frame members 7 interconnect the laterally spaced frame member 1 to thereby provide a rigid frame assembly for supporting an awning 8 positioned in the space between the frames 1. The leading edge of the awning is connected to a drawbar 9, and the trailing edge of the awning is connected to a roll on a drive shaft 10 positioned in proximity to the building 2 and connected to a drive motor 11.

Figure 8:
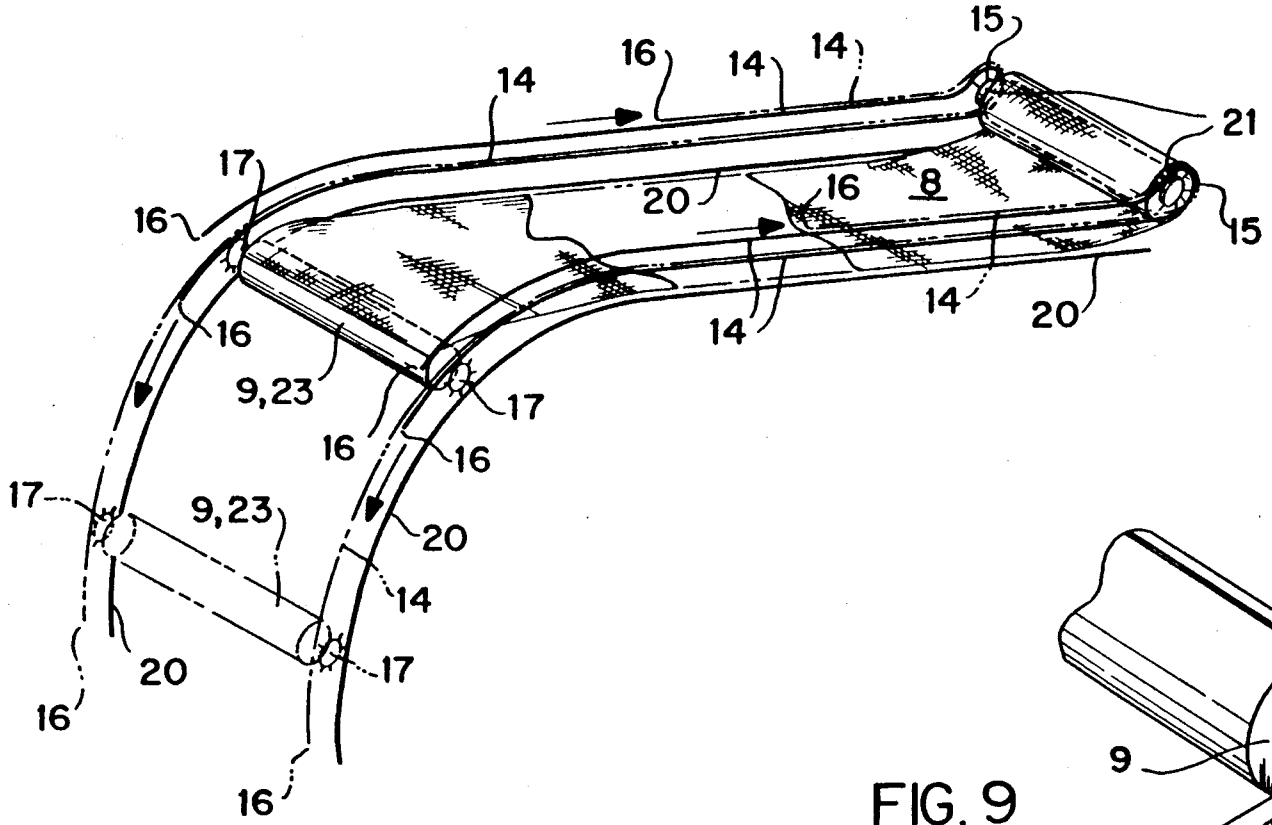
FIG. 8 is a schematic view of the tape drive assembly at opposite ends of the awning.
Figure 9:
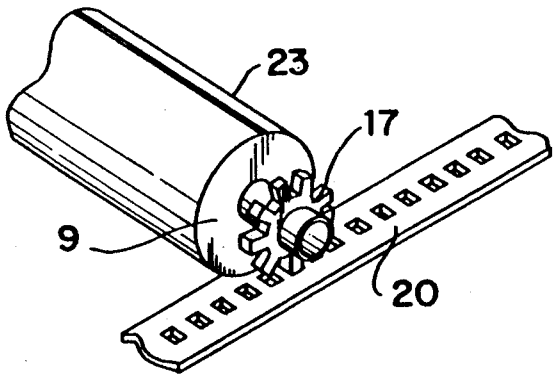
FIG. 9 is a perspective view of a fragmentary portion of the tape used for the tape drive, and specifically showing the stationary tape and the connection to the awning drawbar.

The awning 8 is moved f rom the retracted or stored position to the extended position by a drive tape assembly 12 mounted on each end of the drive shaft 10. As will be seen in FIGS. 2, 4 and 8, each drive tape assembly comprises a sprocket 13 fixed to the drive shaft 10 and having a flexible apertured tape 14 provided with a loop portion 15 extending around the sprocket 13 and a pair of free end portions 16. As will be seen in FIGS. 5 and 8, each end of the drawbar has a sprocket 17 fixed thereto engageable with the lower run of the looped tape 14. By this construction and arrangement, when the motor 11 is energized to extend the awning off the bottom of the roll, the drive shaft 10 via the sprockets 13 drive the lower runs of the looped tapes 14 in the direction of the arrows as shown in FIG. 8 to move the sprockets 17 and associated drawbar 9 and awning downwardly along the frame member 1.

In order to guide the apertured tapes 14 in their movement, each frame 1 houses an extruded channel member 18, and another extruded channel member 19 is mounted in each frame 1 for supporting a fixed length of apertured tape 20 along which the sprocket 17 rolls during the extension and retraction of the awning 8. The channel members 18 and 19 extend the length of the frames 1 so that the flexible apertured tapes 14 are guided through the extent of their travel during the retraction and extension of the awning 8.

Figure 4:
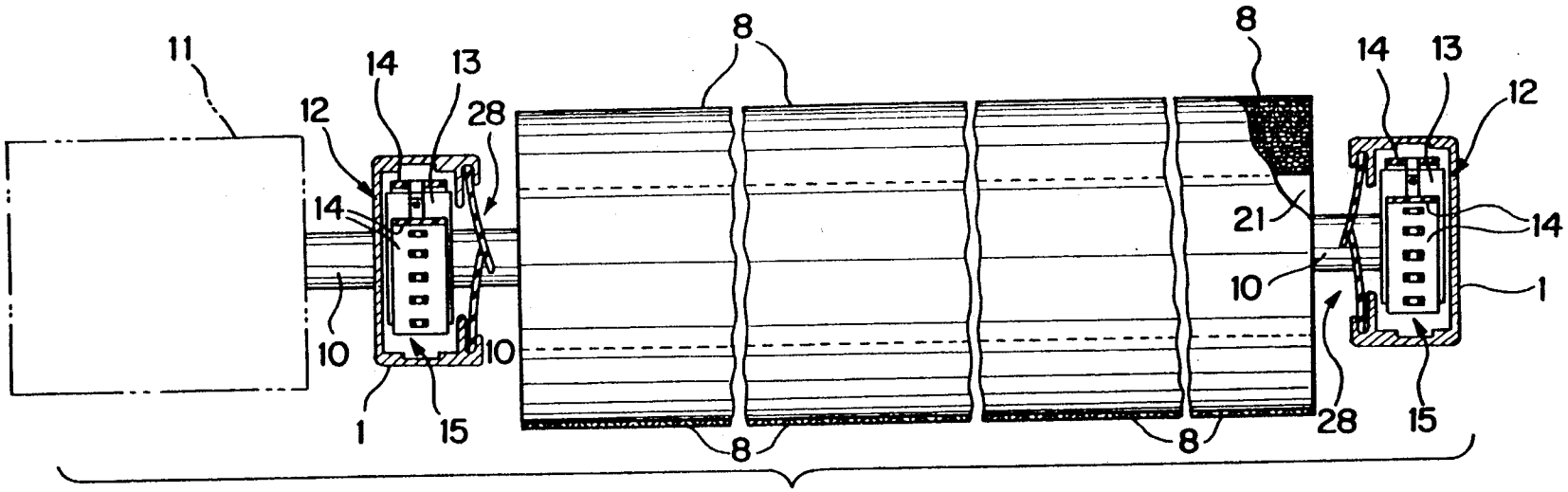
FIG. 4 is an enlarged longitudinal cross-sectional view, partially schematic, taken substantially along line 4—4 of FIG. 1, and showing the common tape drive and awning roll assembly.
Figure 6:
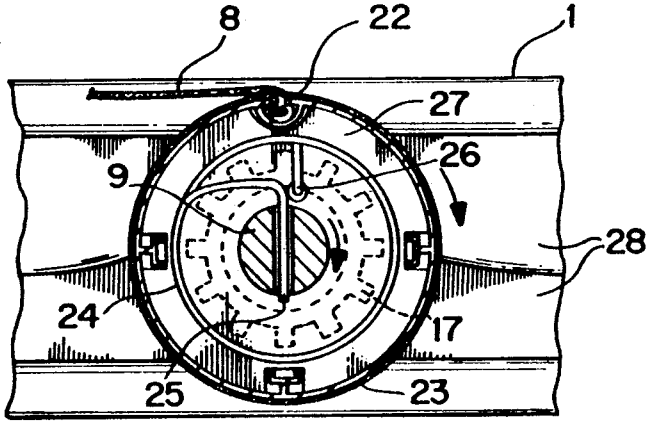
FIG. 6 is a cross-sectional view taken substantially along line 6—6 of FIG. 5 and showing the spring loading mechanism of the drawbar.

As will be seen in FIG. 4, the trailing end of the awning 8 is connected to a roll 21 fixed to the drive shaft 10; and, as will be seen in FIGS. 5 and 6, the leading edge 22 of the awning 8 is connected to a roll 23 connected to the drawbar 9 by a pair of spiral torsion springs 24, each having one end 25 connected to the drawbar 9 and the other end 26 connected to an end wall 27 secured to the end of the roll 23 and through which the drawbar 9 extends. By this construction and arrangement, as the sprockets 17 and associated drawbar 9 are rotated during the extension of the awning 8, the torsion springs 24 will tend to wind up and then unwind, to thereby rotate the roll 23 forwardly, whereby any slack in the awning 8 will be taken up by winding a portion of the awning around the roll 23, as shown in FIG. 6. The slack in the awning is caused by the difference in diameter of the roll 21 from which the awning is unrolled by the motor , and the diameters of the sprockets 13 driving the tapes 14 which move the drawbar 9 forwardly. The awning leaves the storage roll 21 at a faster rate than the tapes 14 are driven forwardly.

To prevent dust, dirt and other debris from entering and accumulating in the frames 1, channels 18, 19, apertured tapes 14 and 20 and sprockets 17, a split, resilient curtain 28 is provided on the inboard side of each frame 1. The split portion of the curtain overlaps to the closed position as shown in FIG. 4, but are forced to the open position as shown in FIG. 5 to allow the passage of the drawbar 9.

From the above description it will be appreciated by those skilled in the art that the tape drive extendable and retractable awning assembly provides an improved awning system which is compact since the one motor 11 drives both sprockets 13 on each end of the drive shaft 10 which in turn extend and retract the apertured tapes 14 connected to the leading edge of the awning 8 on each side thereof and guided in the channels 18, thereby maintaining synchronization for constant, even extension and retraction of the awning, without cocking or binding, and with the provision of the seals 28, it is substantially resistant to outside weather conditions.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A tape drive extendable and retractable awning assembly comprising a pair of parallel, laterally spaced frames, a transversely extending drive shaft extending between said frames, a trailing edge of an awning being operatively connected to said drive shaft, a sprocket fixed to said drive shaft in proximity to each lateral edge of said awning, an apertured tape looped around each drive sprocket and forming a pair of leg portions extending outwardly therefrom and having fee end portions, guide means in the frames supporting said leg portions and said free end portions of each of said apertured looped tapes, said awning having a leading edge, one of the free end portions of each tape being operatively connected to the leading edge of said awning and being substantially adjacent to the leading edge of said awning throughout the extension and retraction of said awning, and the leg portions of each pair having the free end portions operatively connected to said leading edge and being coextensive with said awning throughout the extension and retraction of said awning, whereby a commonly driven drive assembly for opposite lateral edges of the awning is provided which stays in synchronization for constant, even extension and retraction of the awning.

2. A tape drive extendable and retractable awning assembly according to claim 1, in which said guide means are connected in said frames adjacent each lateral edge of said awning and are coextensive with the maximum extension length of said awning.

3. A tape drive extendable and retractable awning assembly according to claim 1, wherein a roll is fixed to the drive shaft, and the trailing edge of said awning being connected to said roll.

4. A tape drive extendable and retractable awning assembly comprising a pair of parallel, laterally spaced frames, a transversely extending drive shaft extending between said frames, a trailing edge of an awning being operatively connected to said drive shaft, a sprocket fixed to said drive shaft in proximity to each lateral edge of said awning, an apertured tape looped around each drive sprocket and forming a pair of leg portions extending outwardly therefrom and having free end portions, said awning having a leading edge, a drawbar connected to said leading edge of said awning, a sprocket on each end of said drawbar engaging one of the free end portions of each tape, and guide means in the frame supporting the leg portions of the looped tapes, whereby a commonly driven drive assembly for opposite lateral edges of the awning is provided which stays in synchronization for constant, even extension and retraction of the awning.

5. A tape drive extendable and retractable awning assembly according to claim 4, wherein a roll is fixed to the drive shaft, and the trailing edge of said awning being connected to said roll.

6. A tape drive extendable and retractable awning assembly according to claim 4, wherein a roll is mounted on the drawbar concentric thereto, and a torsion spring having one end connected to the drawbar and the opposite end connected to the roll, the leading end of the awning being connected to the roll, whereby upon extension of the awning the drawbar and associated sprockets rotate to wind up the torsion spring which subsequently unwinds to wind the leading edge of the awning on the roll to thereby take up slack in the awning to maintain the awning taut during the extension thereof.

7. A tape drive extendable and retractable awning assembly according to claim 4, wherein the guide means comprises an extended channel member mounted in each frame, the leg portions of the looped apertured tapes being slidably mounted in said channel.

8. A tape drive extendable and retractable awning assembly according to claim 7, wherein a second extended channel member is mounted in each of the frames, a fixed apertured tape mounted in said second channel member, the sprockets on each end of said drawbar engaging the fixed apertured tape.

9. A tape drive extendable and retractable awning assembly according to claim 8, wherein the first and second channel members extend the length of the frames, whereby the apertured tapes are supported through the extent of travel of the awning between the retracted and extended positions.

10. A tape drive extendable and retractable awning assembly comprising a pair of parallel, laterally spaced frames, a transversely extending drive shaft extending between said frames, an awning wound on a roll and having opposite lateral edges and a leading edge, a sprocket fixed to said drive shaft in proximity to each lateral edge of said awning, an apertured tape looped around each drive sprocket and forming a pair of leg portions extending outwardly therefrom and having free end portions, guide means in said frames supporting said leg portions and said free end portions of each of said apertured looped tapes, one of the free end portions of each tape being operatively connected to the leading edge of said awning and being substantially adjacent to the leading edge of said awning throughout the extension and retraction of said awning, and the leg portions of said free end portions operatively connected to said leading edge and being coextensive with said awning throughout the extension and retraction of said awning, whereby a commonly driven drive assembly for opposite lateral edges of the awning is provided which stays in synchronization for constant, even extension and retraction of the awning.

11. A tape drive extendable and retractable awning assembly according to claim 10, wherein a drawbar is connected to the leading end of said awning, and means on each end of said drawbar engaging one of the free end portions of each of said tapes, whereby said drawbar is extendable and retractable by said tapes.

12. A tape drive extendable and retractable awning assembly according to claim 10, wherein the guide means comprises an extended channel member mounted in each frame, the leg portions and said free end portions of the looped apertured tapes being slidably mounted in said channel.

13. A tape drive extendable and retractable awning assembly according to claim 12, wherein said channel members extend the length of the frames, whereby the apertured tapes are slidably supported through the extent of travel of the awning between the retracted and extended positions.

* * * * *